US006081077A

United States Patent [19]

Canova et al.

[11] Patent Number: 6,081,077

[45] Date of Patent: Jun. 27, 2000

[54] UNIVERSAL POWER SUPPLY FOR DISCHARGE LAMPS

[75] Inventors: Antonio Canova; David Martini, both of Arezzo, Italy

[73] Assignee: MagneTek, Arezzo, Italy

[21] Appl. No.: 09/109,138

[22] Filed: Jul. 2, 1998

[30] Foreign Application Priority Data

Jul. 2, 1997 [EP] European Pat. Off. ..... 97830331

[51] Int. Cl.[7] ..... G05F 1/00

[52] U.S. Cl. ..... 315/307; 315/224; 315/291; 315/DIG. 5; 315/309

[58] Field of Search ..... 315/307, 224, 315/308, 309, 291, DIG. 5, 300, 297, 209 R

[56] References Cited

U.S. PATENT DOCUMENTS

| | | | |
|---|---|---|---|
| 3,587,061 | 6/1971 | Edward et al. | 340/173 |
| 5,329,209 | 7/1994 | Nepote | 315/209 R |
| 5,426,344 | 6/1995 | Wong | 315/200 R |
| 5,485,060 | 1/1996 | Canova | 315/209 R |
| 5,583,402 | 12/1996 | Moisin et al. | 315/307 |
| 5,589,742 | 12/1996 | Ueda | 315/307 |
| 5,864,212 | 1/1999 | Sullivan | 315/205 |
| 5,900,701 | 5/1999 | Guhilot et al. | 315/307 |

FOREIGN PATENT DOCUMENTS

| | | | |
|---|---|---|---|
| 0 413 991 A1 | 7/1990 | Germany | H05B 41/29 |
| 0 488 478 A2 | 11/1991 | Germany | H02M 5/458 |
| 0 594 880 A1 | 10/1992 | Germany | H05B 41/29 |
| 0 621 743 A1 | 4/1994 | Germany | H05B 41/29 |
| 0 677 981 A1 | 4/1994 | Germany | H05B 41/29 |
| 0 697 803 A2 | 8/1995 | Germany | H05B 41/29 |
| 0 759 686 A2 | 8/1996 | Germany | H05B 41/36 |
| 0 413 991 A1 | 2/1991 | Japan | 41/29 |

*Primary Examiner*—Don Wong
*Assistant Examiner*—Tuyet T. Vo
*Attorney, Agent, or Firm*—Waddey & Patterson; Mark J. Patterson

[57] ABSTRACT

A power supply circuit for discharge lamps having a load circuit with at least one discharge lamp and controlled switches with a switching control means which control the opening and closing of the switches to supply the load circuit with a high-frequency alternating signal. A recognition circuit, which recognizes the type of lamp connected to the load circuit by the power rating of the lamp, is provided. Control means which modify the switching conditions of the switches according to the type of lamp connected to the load circuit are also provided.

37 Claims, 9 Drawing Sheets

11
15
25
21
13
19
L
23
17
27
OSC
μP
31
ST
EEPROM
29

V
T1
T2
T3
I

UNIVERSAL POWER SUPPLY FOR DISCHARGE LAMPS

BACKGROUND OF THE INVENTION

The present invention relates to a power supply circuit for low-pressure discharge lamps, of the type comprising an inverter with two controlled switches which are alternately made conducting and isolating to supply a load circuit, comprising at least one lamp, with a high-frequency alternating voltage.

This type of circuit is used to supply discharge lamps of various types. Inverter power supply circuits are described, for example, in EP-A-0621743, U.S. Pat. No. 5,426,344, EP-A-0488478, U.S. Pat. No. 5,479,334, EP-A-0697803, U.S. Pat. No. 5,485,060.

At present there are various types of discharge lamp available on the market, which differ from each other in their external dimensions and in their internal characteristics, particularly in the power drawn. At present, where tubular lamps are concerned, there are, for example, two classes of lamps distinguished by their external dimensions and lamps of varying power are grouped in each category. The symbol T5 is used to identify tubular discharge lamps with a small external diameter, available with power ratings of 14 and 24 watts (lamps T5FH and T5FQ). Lamps of larger diameter are identified by the symbol T8 and are available in three different versions, namely 18, 36 and 58 watts. The ballasts or inverter power supplies available at present on the market are designed for a single type of lamp, so that there is the disadvantage of having to have a large number of inverters for the various lamps. Where compact lamps are concerned, there are different shapes and connections corresponding to different power ratings.

Furthermore, the lamps in each category are externally identical, so that there is a risk of connecting a lamp with a particular power rating in a power supply circuit designed for a different power, resulting in an incorrect power supply to the lamp.

The object of the present invention is to provide an inverter power supply which overcomes the disadvantages mentioned above.

SUMMARY OF THE INVENTION

Essentially, according to the invention, a power supply circuit for discharge lamps is provided, comprising a load circuit having at least one discharge lamp and controlled switches with switching control means which control the opening and closing of the switches to supply the load circuit with a high-frequency alternating voltage. Characteristically, the power supply circuit according to the invention provides a recognition circuit which recognizes the type of lamp connected to the load circuit and an oscillator which modifies the switching conditions of the switches according to the type of lamp connected to the load circuit.

In this way it is possible, on the one hand, to provide a single power supply, or a limited number of power supplies, for all the lamps available on the market, with considerable advantages both for the manufacturer and for the retailers and users. On the other hand, there is the elimination of the disadvantages arising from the possibility of connecting an incorrect lamp to a power supply not designed to supply this type of lamp.

As will be made clear subsequently with reference to a number of possible embodiments, the inventive concept on which the invention is based may be applied both to power supplies of the self-oscillating type, with control transformers for switching the switches, and to power supplies in which the switches are controlled by means of integrated circuits. In the case of self-oscillating circuits, the power supply conditions of the lamp can be modified by varying the hysteresis of the control transformer, or the peak saturation voltage across the terminals of one of the secondary windings of the control transformer, or by providing a cyclic switch-off, for a time which can be pre-set, of the self-oscillating circuit.

In the case of switches controlled by an integrated circuit, the power supply conditions of the lamp may be modified, for example, by varying the switching frequency or the duty cycle of the switches, or again by providing for the temporary and cyclic switch-off of the switches for time intervals which can be modified according to the type of lamp connected to the load circuit.

Various possible methods of varying the power supply conditions of the lamp will be described in greater detail in the following text.

Both in the case of self-oscillating circuits and in the case of circuits in which the switching of the switches is controlled by a suitable integrated circuit, the circuit for recognizing the type of lamp connected to the load circuit is preferably based on the recognition of the resistance of the filaments of the lamp. This recognition may take place in the cold state, for those lamps whose filaments have sufficiently different resistances when cold, or in the hot state, for those lamps whose filament resistances are identical in the cold state, but vary with the temperature and therefore become different in power supply conditions.

Other methods of recognition of the lamp, for example by identification of the voltage at its terminals, are not excluded. Indeed, the discharge lamps available at the present time on the market differ not only in the resistance of the filaments, but also in the potential difference developed between the filaments. At present, this potential difference depends on the ambient temperature. It is therefore useful for the recognition circuit to be capable of recognizing the lamp in different conditions of ambient temperature, and for this purpose a temperature sensor may be provided, associated, for example, with a microprocessor connected in the recognition circuit.

Further advantageous characteristics and embodiments of the power supply circuit according to the invention are indicated in the attached claims and described in the following text with reference to the attached drawings.

The invention will be more clearly understood from the description and the attached drawings, which show practical non-restrictive embodiments of the invention.

DESCRIPTION OF THE PREFERRED EMBODIMENTS

Figure 1:
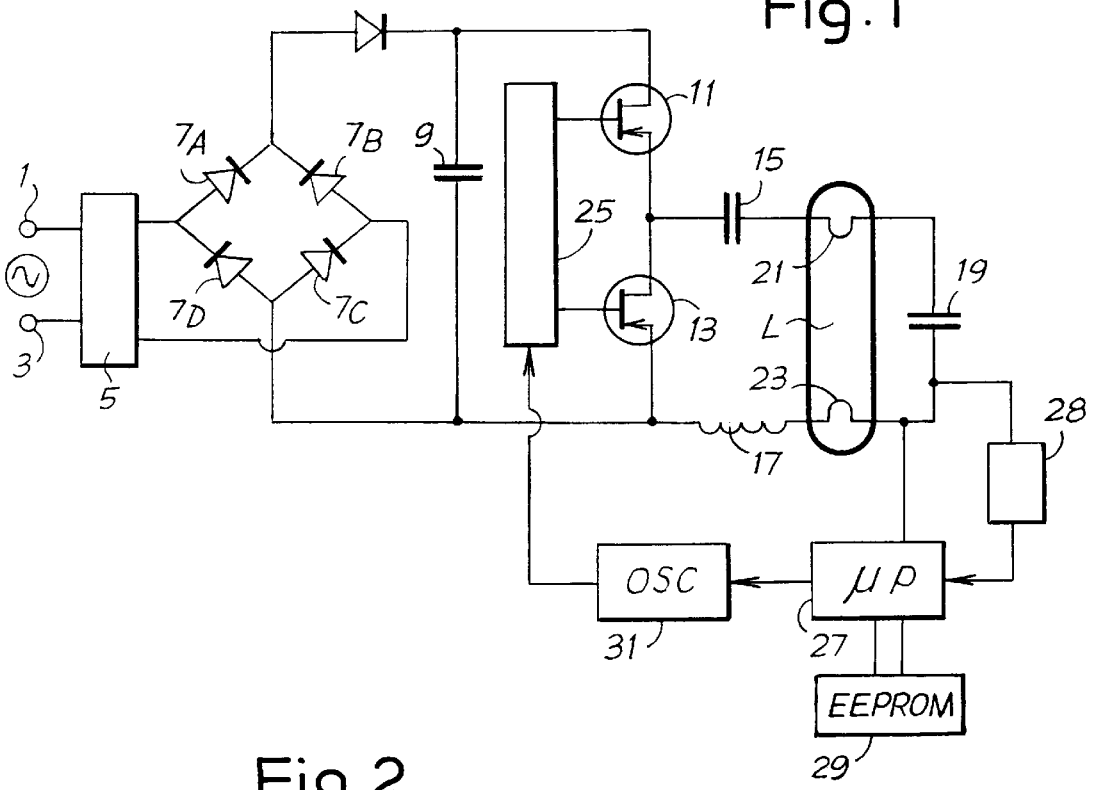
FIG. 1 is a schematic diagram of the power supply circuit according to the invention with an oscillator associated with the control circuit of the switches of the inverter.

FIG. 1 shows schematically a power supply circuit for a discharge lamp L. The numbers 1 and 3 indicate the connections to an alternating current power supply network, for example the normal electrical mains. The number 5 indicates a filter interposed between the power supply network and a rectifier bridge formed by four diodes 7A–7D. The number 9 indicates a smoothing capacitor and 11 and 13 indicate two controlled switches, which are alternately made conducting and isolating to supply an oscillating load circuit comprising, in addition to the lamp L, an inductor 17 in series with a capacitor 19 and in parallel with the lamp L. The number 15 indicates a capacitor in series with the lamp L. The opening and closing of the switches 11, 13 are controlled by a switching control means 25, such as an integrated control circuit, of a type known in itself.

The load circuit comprising the lamp L is connected to a microprocessor 27, having an EEPROM memory 29, which controls an oscillator 31 in the way described below.

The lamps of class T8 have filaments which have resistances in the hot and cold states which vary from lamp to lamp as a function of the power. The difference between the hot resistance of the various lamps is more marked than the difference between the filament resistances of the lamps in the cold state, with the ratio between the hot and cold resistances remaining approximately constant at 4.5–5.5 for the various types of lamp. It is therefore useful to measure the resistance in the hot state to obtain greater resolution.

At the operating temperature, to which the filaments 21, 23 are raised when the discharge lamp L is in the normal operating conditions, supplied with the correct current corresponding to the rated power of the lamp L, each lamp of class T8 has different filament temperatures and consequently different filament resistances which are greater than the values of resistance in the cold state, the filament resistances having a positive temperature coefficient.

In this embodiment, the circuit according to the invention is based on this circumstance, to recognize the type of lamp connected to the load circuit and consequently to modify the power supply conditions of the circuit.

In practice, the microprocessor 27 is programmed to recognize the lamp L among a set of possible lamps which differ in the power drawn. It is programmed in such a way that when the power supply circuit is switched on, the lamp L is supplied with the minimum current; in other words, that correspond to the lamp L with the minimum power available on the market. At present, in the case of lamps of class TS, the minimum available power is 18 watts.

The lamp L is supplied at the minimum current until the filaments 21, 23 have heated up and have reached a substantially constant temperature. This temperature corresponds to a certain resistance which can be measured easily, since the supply current is known. If the lamp L is supplied with the correct value of current, in other words with the value corresponding to the rated power of the lamp L, the filaments 21, 23 have reached the temperature and consequently the (known) resistance of operation in normal operating conditions. The microprocessor 27 recognizes this situation and maintains the power supply conditions without modification.

If the lamp L has a power rating different from that corresponding to the supply current, the lamp L will be under-powered, so that the temperature reached by the filaments 21, 23 (and therefore their resistance) will be lower than the nominal operating temperature. The microprocessor 27 recognizes this under-powering situation and therefore emits a signal which increases the supply current to the lamp L to the value corresponding to the supply current for the lamp L with a higher power rating. At this point the checking cycle recommences.

Figure 3:
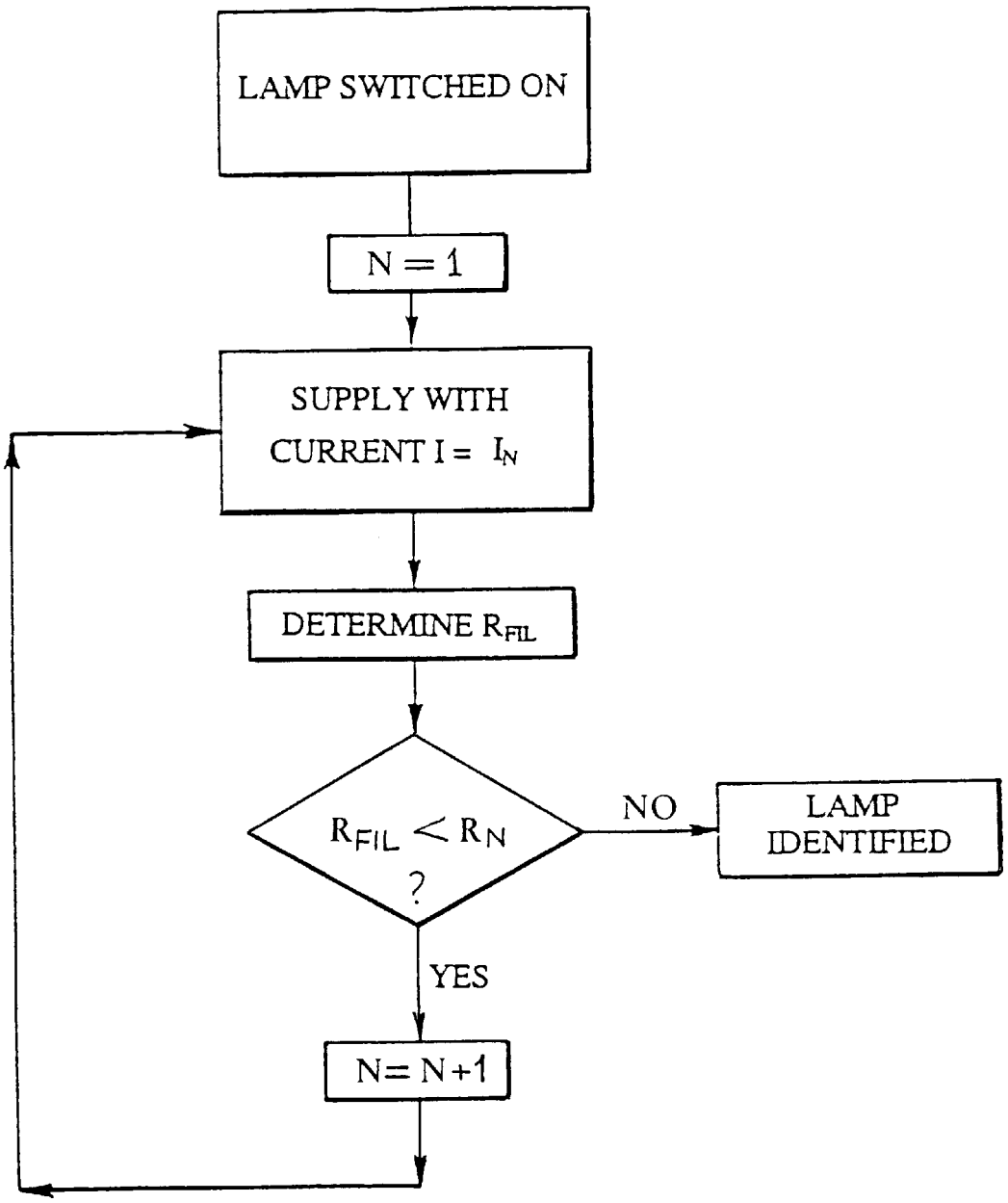
FIG. 3 is a block diagram of the method for checking if the lamp is underpowered.

The check algorithm described in summary form is shown in the block diagram in FIG. 3, where the letter N indicates a counter which can have a value from 1 to a number corresponding to the maximum number of lamps recognizable by the circuit, a progressive value of lamp power corresponding to each progressive number. For example, in the case of lamps of class T8, N=1, 2 or 3 for power ratings of 18 W, 36 W and 54 W respectively. The letter I indicates the supply current of the load circuit, $I_N$ indicates the nominal supply current for the N-th lamp of the set of lamps recognizable by the system, $R_N$ indicates the resistance of the filament of the lamp with a supply current $I_N$ applied, and $R_N$ indicates the resistance which the filament of the N-th lamp of the set has when it is supplied at the correct current value.

The checking cycle is reiterated with the counter N incremented on each occasion until the microprocessor 27 finds that the resistance $R_{FIL}$ of the filament of the connected lamp L is equal to or greater than the nominal value $R_N$. The power supply conditions of the lamp L are modified by means of the oscillator 31 in the way which will be illustrated subsequently.

Figure 4:
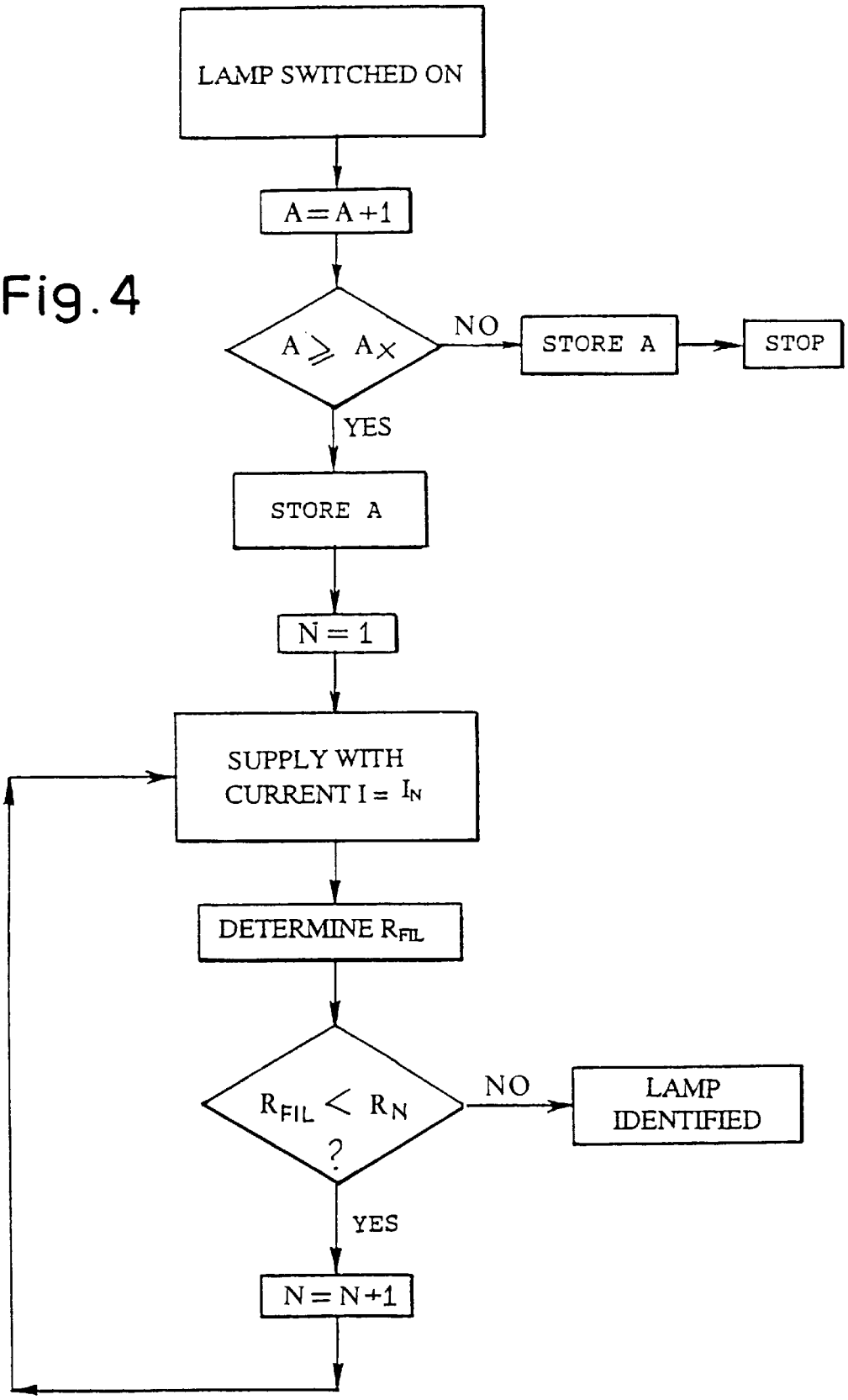
FIG. 4 is a block diagram of the method for checking if the lamp is underpowered, the method providing for checking only once every predetermined period.

In the illustrated example, the cycle for checking the type of lamp connected to the load circuit is repeated with every switch-on of the lamp L. However, this is not necessary, since when the lamp L has been connected, the type of lamp has been recognized and the correct power supply condition has been set, and this can be maintained until the lamp L is replaced. It is therefore possible to program the microprocessor 27 so that it carries out the check once in every predetermined number of switch-ons, as shown in FIG. 4, where the letter A indicates a counter which is incremented with every switch-on and $A_x$ indicates the number of switch-ons between one check and the next.

Figure 5:
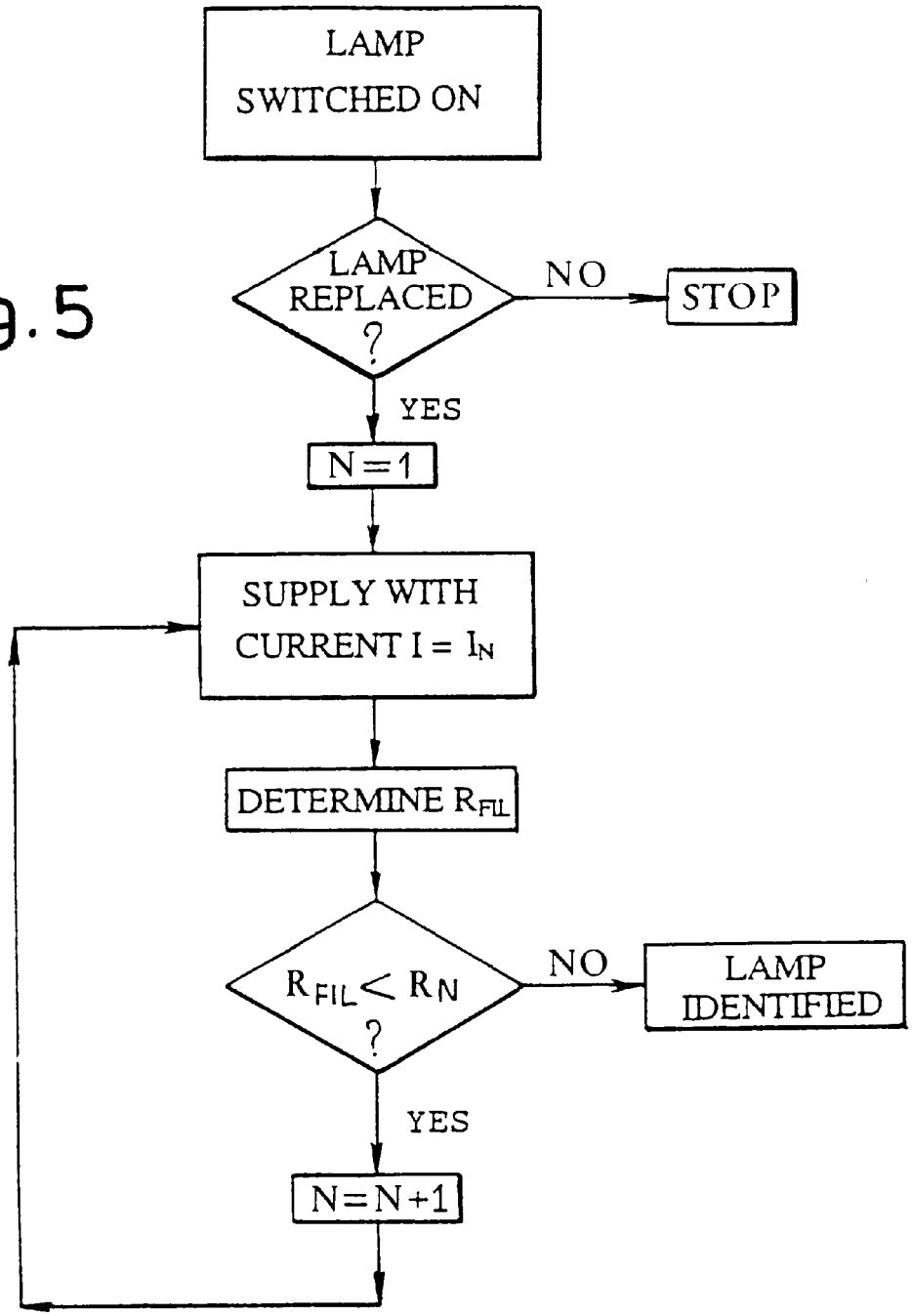
FIG. 5 is block diagram of the method for checking if the lamp is underpowered, the method providing for checking only after the replacement of a lamp.

Conversely, FIG. 5 shows the check algorithm in the case in which the check is made only at a switch-on following a replacement of the lamp L. For this purpose, it is necessary to provide means which inform the microprocessor 27 that the removal and replacement of the lamp L has taken place. For this purpose it is possible to provide, for example, a sensor 28, whose output has a high value at the first switch-on of the lamp L and maintains this value until the lamp L is removed, in case of failure for example. On such an occasion, the output of the sensor 28 has a value of zero, and remains at this value until the microprocessor 27 has carried out the new recognition of the lamp L after its replacement. The replacement must take place with the ballast switched on so that the sensor 28 can detect that the replacement has taken place.

Figure 2:
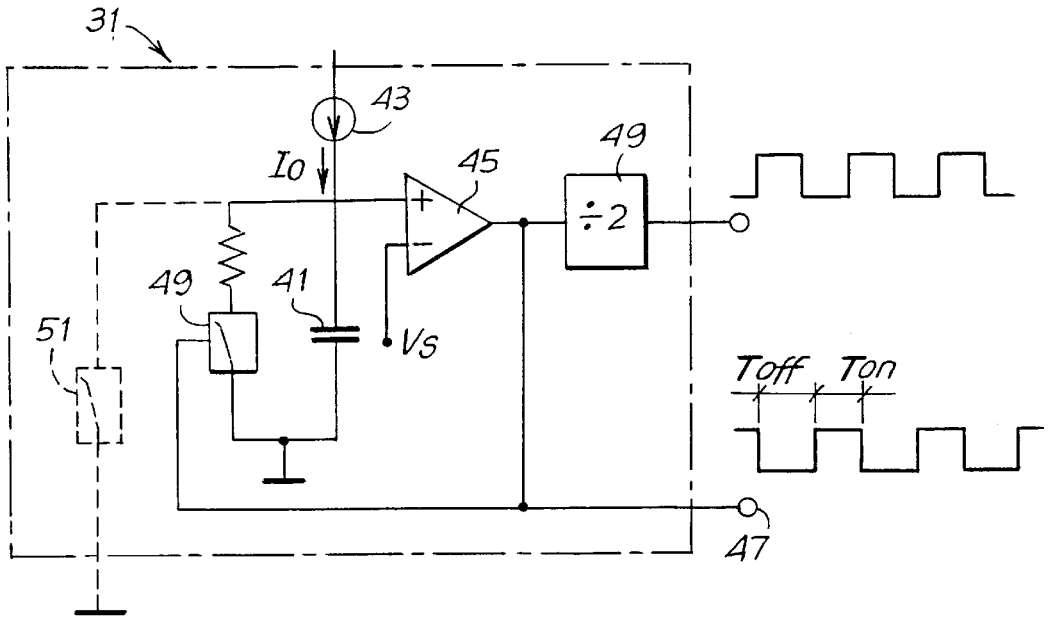
FIG. 2 is a schematic diagram of the oscillator shown in FIG. 1.

FIG. 2 is a diagram of the oscillator 31. It has a capacitor 41 which is charged by a current $I_o$ from a current source 43. The voltage across the capacitor 41 is applied to the positive input of a comparator 45 to whose negative input a threshold voltage $V_S$ is applied. The output 47 of the comparator 45 is low (0) until the voltage across the capacitor 41 is lower than the threshold voltage $V_S$, while it changes to the high value (1) when the voltage across the terminals of the capacitor 41 is equal to the threshold voltage $V_S$. When the output of the comparator 45 switches from 0 to 1, the switch 49 is closed to discharge the capacitor 41 and then reopens to recommence the capacitor charging cycle. The discharge time of the capacitor 41 is constant, while the charging time varies with the variation of the current $I_o$ supplied by the current generator 43. It is therefore possible to vary the duty cycle of the signal on the output 47 of the comparator 45 by varying the current $I_o$.

Figure 6:
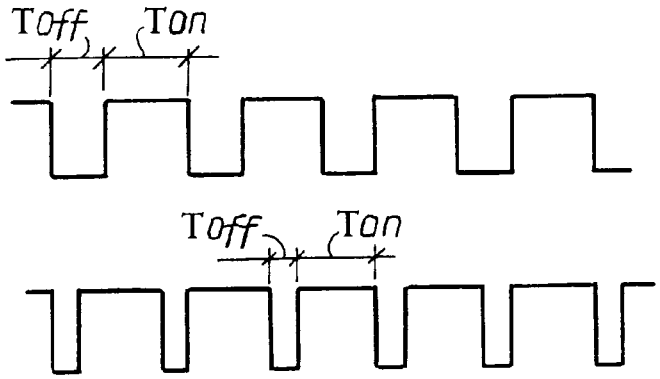
FIG. 6 shows the waveform of the switching signal when the conduction time $T_{on}$ is kept constant and the isolation time $T_{off}$ is varied.

If the signal on the output 47 is used to control the switches 11, 13 of the inverter directly, the supply current to the lamp L can be modified by varying the time $T_{off}$ (see FIG. 2) of the signal at the output of the oscillator 31 and consequently the duty cycle of the switching signal of the switches 11, 13. FIG. 6 shows the waveform of the switching signal for two different operating conditions. As shown in FIG. 6, the conduction time $T_{on}$ is kept constant and the isolation time $T_{off}$ of the controlled switches 11, 13 is varied.

Figure 7:
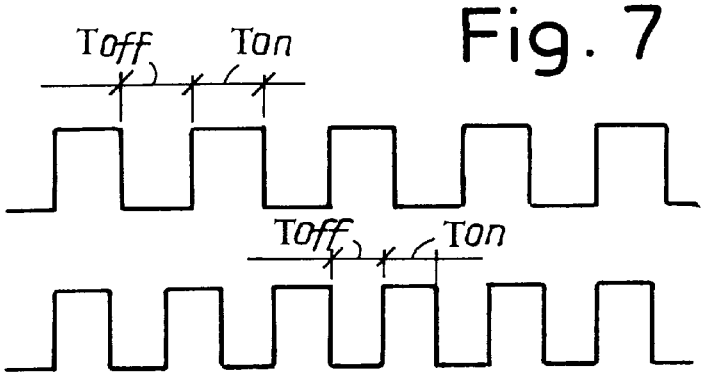
FIG. 7 shows the waveform of the switching signal in different power supply conditions.

Alternatively, it is possible to modify the power supply conditions of the lamp L by varying the frequency of the switching signal. This may be done by sending the signal at the output of the comparator 45 to a divider 50 whose output is represented by a symmetrical square wave signal, at a frequency which is a function of the charging time of the capacitor 41, and which is used as a switching signal for the switches 11, 13. FIG. 7 shows the waveform of the switching signal in two different power supply conditions.

Instead of varying the current $I_o$ to modify the charging time of the capacitor 41, it is also possible to make the oscillator 31 operate at constant frequency, for example of the order of tens of kHz, and to have this stopped for intervals of time which can be varied and set. This may be done, for example, by providing a control switch 51 operated by the microprocessor 27, with a fixed open time and a variable closed time. When the switch 51 is open, the oscillator 31 generates at the output a high-frequency driving signal for the controllable switches 11, 13 of the inverter, so that the lamp L is supplied at a specific frequency. When the switch 51 is closed, the output signal of the oscillator 31 is low, and the controlled switches 11, 13 are turned off, so that the power supply to the lamp L is interrupted.

Figure 8:
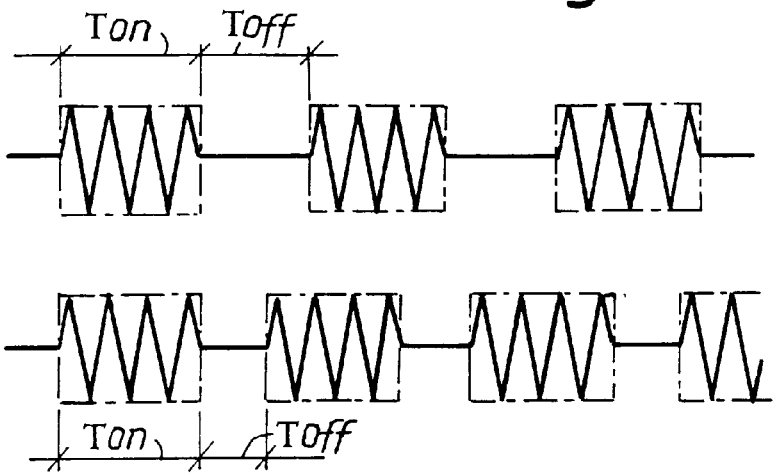
FIG. 8 shows the variation of the current in the load circuit during the intervals of $T_{on}$ and $T_{off}$.

By increasing or reducing the closed time of the control switch 51, the power supply conditions of the lamp L are varied according to the type of lamp, while the switching frequency of the inverter is kept constant. FIG. 8 shows the variation of the current to the load circuit in two different power supply conditions. In the intervals $T_{on}$, the lamp L is supplied at a specific frequency, while in the intervals $T_{off}$ the lamp L is not supplied. The duration of the time $T_{off}$ varies according to the type of lamp L connected to the load circuit.

Figure 9:
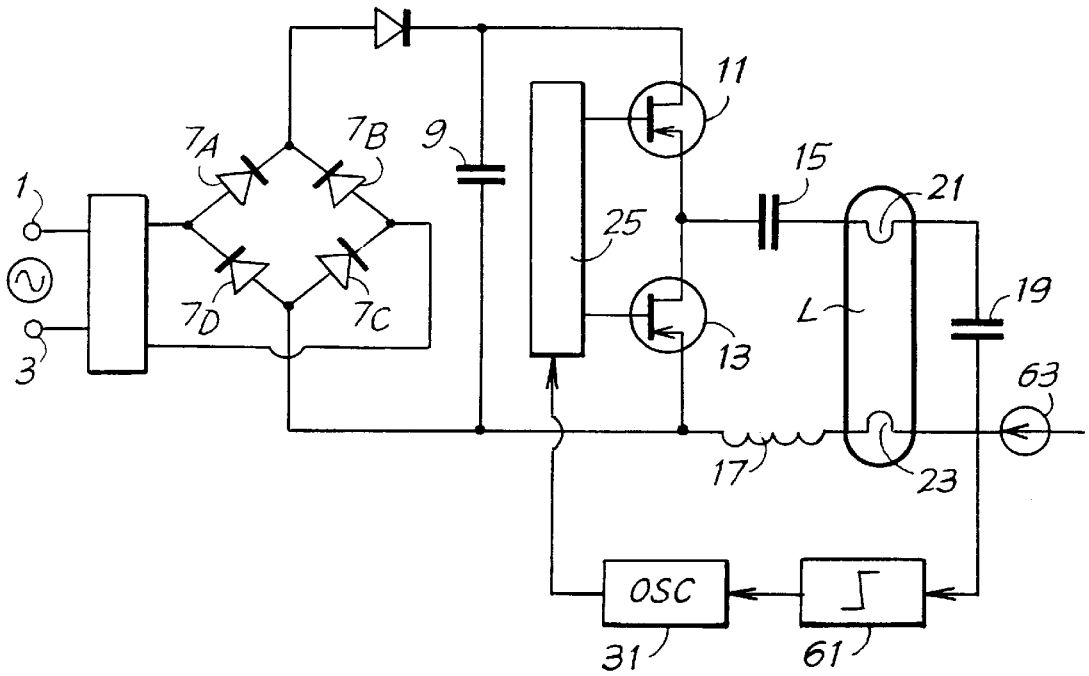
FIG. 9 is a schematic diagram of the power supply circuit according to the invention as shown in FIG. 1 with the threshold circuit being shown as an element.

Some types of lamps, and in particular lamps belonging to the T5 class, have filaments 21, 23 which have different resistances in the cold state. In this case, it is not necessary to heat the filaments 21, 23 to determine the type of lamp connected to the load circuit; it is sufficient to measure the resistance of the filaments 21, 23 of the lamp L in the cold state. It is therefore possible to provide a simple threshold circuit 61 and a current generator 63 associated with one of the filaments of the lamp L, as shown in FIG. 9. The signal at the output of the threshold circuit 61 is sent to the oscillator 31 which modifies the behaviour of the switching control means 25 in the way described previously. If it is necessary to recognize more than two lamps, which are all different from each other in respect of the resistance of the filaments 21, 23 in the cold state, it is sufficient to provide a number of threshold circuits 61 in series or in parallel.

Figure 10:
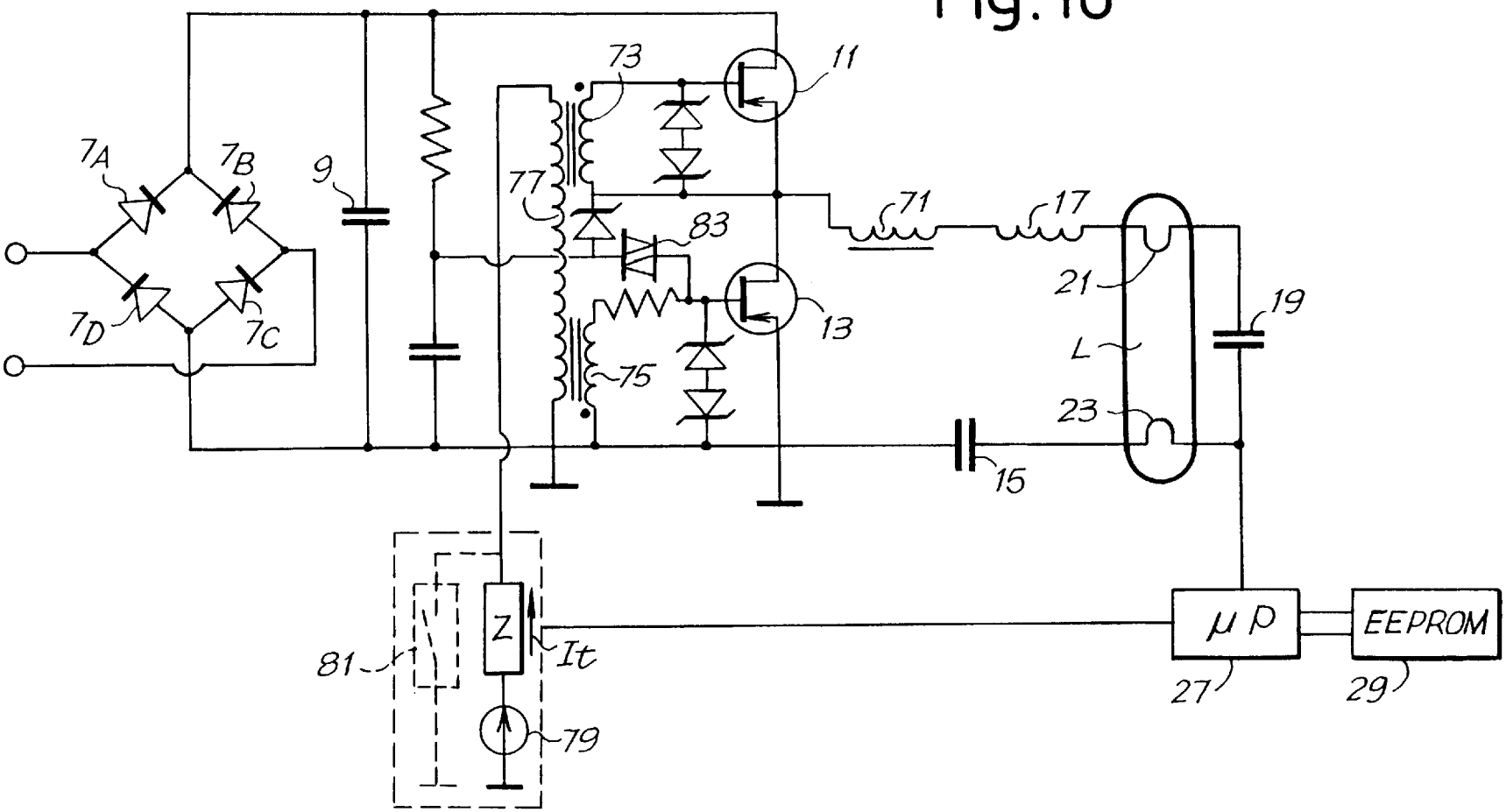
FIG. 10 is a schematic diagram of the power supply circuit according to the present invention having a universal inverter.

In the preceding text, reference has been made to an inverter with an integrated circuit for controlling the switching of the controlled switches 11, 13. However, it is possible to provide a universal inverter which also has a configuration of the self-oscillating type. This possibility is illustrated with reference to FIG. 10, in which identical or equivalent parts are indicated by the same reference numbers as those used in FIG. 1. In this embodiment, the load circuit comprises a winding 71 which forms the primary winding of a saturable control transformer, whose two secondary windings 73, 75 are connected to the bases of the transistors 11, 13. The operation of the inverter in this configuration is known and will not be described in greater detail.

In this case, the power supply condition of the lamp L can be modified by varying the conditions of saturation of the control transformer 71, 73, 75. For this purpose, an auxiliary winding 77 is provided, associated with a current generator 79. The current $I_t$ supplied by the current generator 79 modifies the saturation time of the control transformer 71, 73, 75 of the inverter, and consequently modifies the switching frequency of the switches 11, 13. As in the case described previously, the microprocessor 27 determines, by the method illustrated in FIGS. 3, 4, or 5, the type of lamp L connected to the load circuit. The microprocessor 27 consequently sets the current $I_t$ which the current generator 79 must supply to obtain the correct power supply for the lamp L.

Alternatively, it is possible to provide, in place of the current generator 79, an auxiliary switch 81 which is cyclically closed for time intervals which can be determined by the microprocessor 27. When the auxiliary switch 81 is closed, the self-oscillating circuit is switched off and the supply to the lamp L is interrupted. When the auxiliary switch 81 is opened, the self-oscillating circuit is again switched on by a starting diac 83, and the lamp L is supplied at a fixed frequency for the time interval in which the auxiliary switch 81 remains open. The current to the lamp L has the variation shown in FIG. 8 and the power supply conditions of the lamp L are modified according to the type of lamp by varying the closed time $T_{off}$ of the switch 81.

Figure 11:
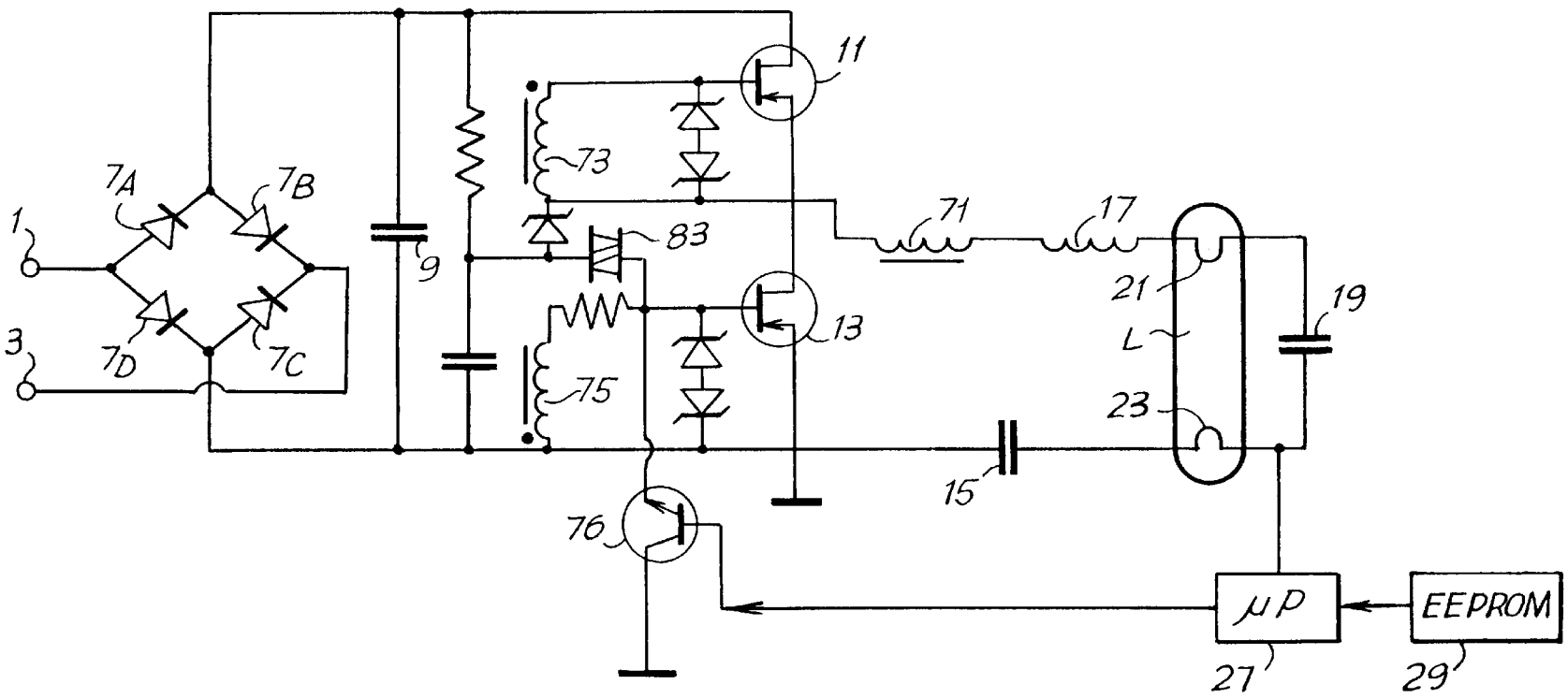
FIG. 11 is a schematic diagram of the power supply circuit according to the present invention having self-oscillating inverter.

FIG. 11 shows a different embodiment of the self-oscillating inverter, in which the power supply condition of the lamp L is modified by varying the base voltage of a switch 76. For this purpose, one of the terminals of the secondary winding 75 is connected to the transistor 76, whose base is connected to the microprocessor 27, which thus controls the voltage in the winding 75. Since the switch-on time of the switches 11, 13 is linked to the voltage across the terminals of the secondary windings 75 of the control transformer 71, 73, 75 by the relation:

$$T_{on}=(\Phi_{sat}N)/V$$

where $\Phi_{sat}$ is the magnetic flux of saturation of the control transformer and N is the number of turns of the winding, it is possible, by varying V, to vary $T_{on}$ and consequently the power supply conditions of the lamp L.

In the case of self-oscillating inverters also, the recognition of the lamp L connected to the load circuit, and consequently the determination of the power supply conditions of the lamp L, may take place for certain types of lamp with a threshold circuit as described with reference to FIG. 9.

Discharge lamps have a potential difference between the electrodes 21, 23 which is a function of the supply current I and of the type of lamp. It is therefore theoretically also possible to construct a circuit capable of recognizing the type of lamp connected to the load circuit from the voltage across the terminals of the lamp L, instead of from the resistance of the filament 21, 23.

Figure 12:
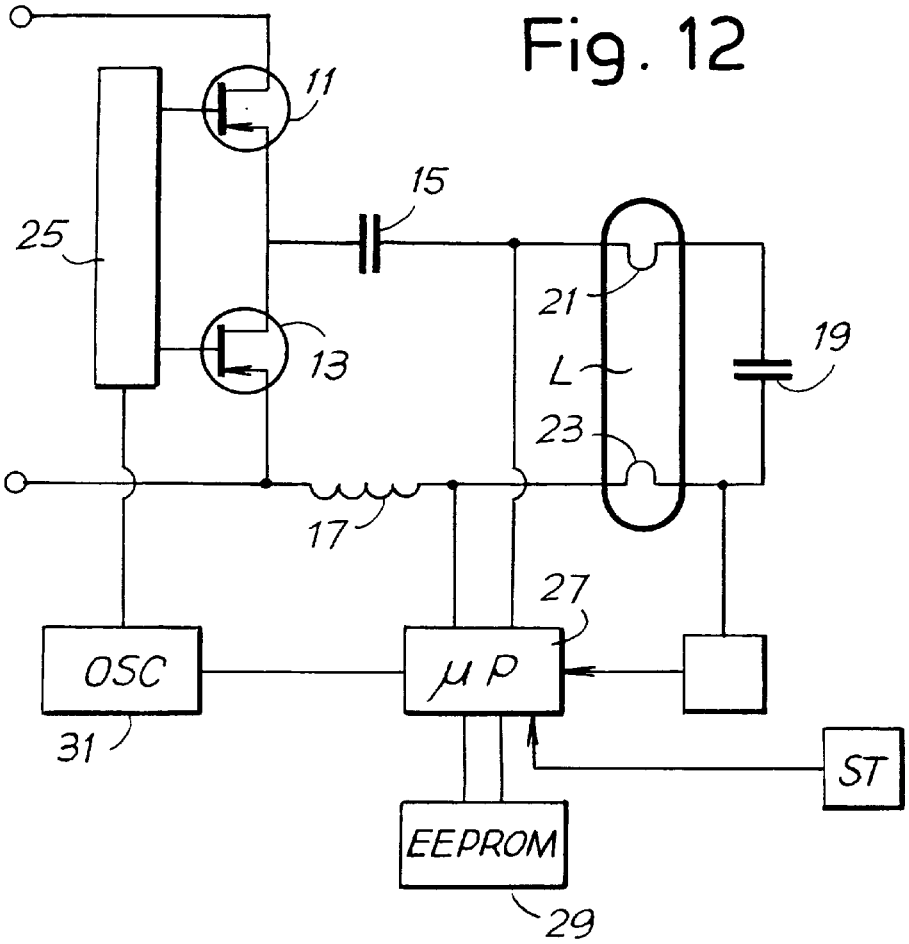
FIG. 12 is a diagram of a power supply with recognition of the lamp by measurement of the voltage between the electrodes.
Figure 13:
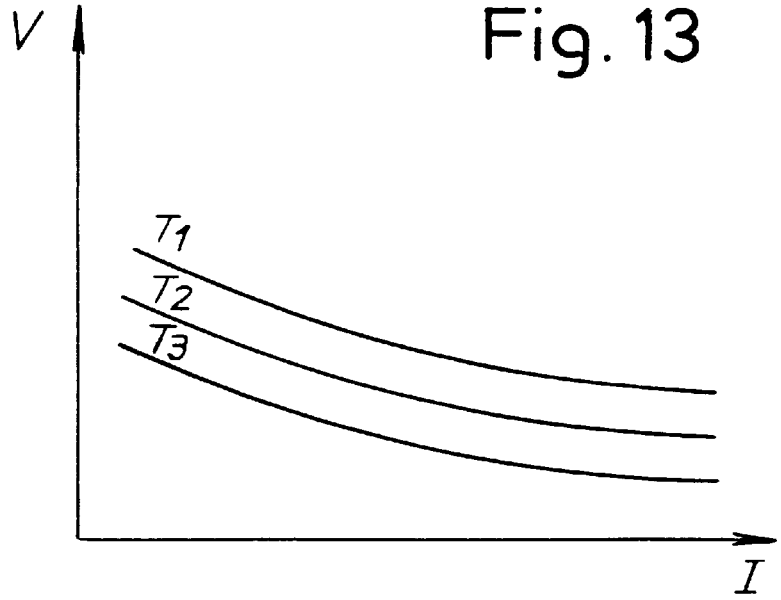
FIG. 13 is a diagram of the voltage across the terminals of the lamp as a function of the current for various temperatures.

FIG. 12 is a diagram of a power supply similar to that shown in FIG. 1, in which identical or corresponding parts are indicated by the same reference numbers, and in which the microprocessor 27 is connected to the load circuit in such a way as to measure the voltage between the electrodes of the lamp L. This voltage varies, as a function of the current flowing in the electrodes, as shown in the diagram in FIG. 13, where the current is shown on the horizontal axis and the voltage across the terminals of the lamp L is shown on the vertical axis. The characteristic V(I) varies as a function of the ambient temperature T. It is therefore necessary in this case for the microprocessor 27 to be associated with an ambient temperature sensor $S_t$. When the ambient temperature has been identified, the microprocessor 27 is able to select the reference curve V(I). A plurality of such curves for different values $T_1$, $T_2$, $T_3$ . . . may be stored, for example, in tabular form in the EEPROM 29.

The algorithm for the recognition of the connected lamp may be the same as that described with reference to the diagrams in FIGS. 3, 4, or 5, with the difference that for each value of current $I_N$ a voltage $V_N$ is measured instead of a filament resistance.

It is to be understood that the drawing shows only an example provided solely as a practical demonstration of the invention, and that the invention may vary in its forms and dispositions without departure from the scope of the guiding concept of the invention. Any presence of reference numbers in the attached claims has the purpose of facilitating the reading of the claims with reference to the description and to the drawing, and does not limit the scope of the protection represented by the claims.

Thus, although there have been described particular embodiments of the present invention of a new and useful universal power supply for discharge lamps, it is not intended that such references be construed as limitations upon the scope of this invention except as set forth in the following claims.

What is claimed is:

1. A power supply circuit for discharge lamps having a least one filament comprising:

an inverter including a pair of inverter switches;

a load circuit connected to the inverter and adapted to receive at least one discharge lamp having a power rating;

a recognition circuit connected to the load circuit, the recognition circuit identifying the lamp connected to the load circuit by the power rating of the lamp;

a switching control means connected to the inverter switches and controlling the opening and closing of the inverter switches to supply the load circuit with a high frequency alternating signal;

the switching control means responsive to the recognition circuit to vary the signal supplied to the load circuit according to the power rating of the lamp;

a control transformer having an auxiliary winding;

wherein the recognition circuit modifies the conditions of current flow in the auxiliary winding according to the power rating of the lamp connected to the load circuit a current source connected between the recognition circuit and the auxiliary winding, the current source providing current to the auxiliary winding as directed by the recognition circuit; and an auxiliary switch, the auxiliary switch being connected between the auxiliary winding and ground, the auxiliary switch being controlled by the recognition circuit to control the switching of the inverter switches to make the inverter switches simultaneously isolating.

2. A power supply circuit for discharge lamps having a least one filament comprising:

an inverter including a pair of inverter switches;

a load circuit connected to the inverter and adapted to receive at least one discharge lamp having a power rating; and a recognition circuit connected to the load circuit, the recognition circuit identifying the lamp connected to the load circuit by the power rating of the lamp, wherein the recognition circuit determines the resistance of the filament of the lamp in the hot state.

3. A power supply circuit for discharge lamps having a least one filament comprising:

an inverter including a pair of inverter switches;

a load circuit connected to the inverter and adapted to receive at least one discharge lamp having a power rating; and a recognition circuit connected to the load circuit, the recognition circuit identifying the lamp connected to the load circuit by the power rating of the lamp wherein the recognition circuit comprises a microprocessor;

wherein the microprocessor determines the resistance of at least one filament of the lamp and compares the resistance with the temperature corresponding to the condition of correct supply of the lamp.

4. A power supply circuit for discharge lamps having a least one filament comprising:

an inverter including a pair of inverter switches;

a load circuit connected to the inverter and adapted to receive at least one discharge lamp having a power rating; and a recognition circuit connected to the load circuit, the recognition circuit identifying the lamp connected to the load circuit by the power rating of the lamp, wherein the recognition circuit determines the resistance of the lamp filament in the cold state.

5. A method for supplying a correct amount of current to a lamp having a filament according to the power rating of the lamp, the lamp being connected to a power supply circuit having a recognition circuit, the method comprising:

storing a list of standard power ratings for various lamps in the recognition circuit;

supplying the lamp with a current equal to the supply current for the lamp having the lowest power rating of a group of lamps recognizable by the recognition circuit; and examining the lamp to determine that the supply current is the amount the lamp requires, by determining the resistance of the filament.

6. The method of claim 5, further comprising incrementing the supply current provided to the lamps after the step of examining the lamp if the current supplied does not correspond to the power factor rating.

7. A method for supplying a correct amount of current to a lamp having two terminals according to the power rating of the lamp, the lamp being connected to a power supply circuit having a recognition circuit, the method comprising:

storing a list of standard power ratings for various lamps in the recognition circuit;

supplying the lamp with a current equal to the supply current for the lamp having the lowest power rating of a group of lamps recognizable by the recognition circuit; and examining the lamp to determine that the supply current is the amount the lamp requires, by determining the voltage across the terminals of the lamp and the ambient temperature.

8. The method of claim 7, further comprising incrementing the supply current provided to the lamps after the step of examining the lamp if the current supplied does not correspond to the power factor rating.

9. A power supply circuit for discharge lamps having a least one filament comprising:

an inverter including a pair of inverter switches;

a load circuit connected to the inverter and adapted to receive at least one discharge lamp having a power rating;

a recognition circuit connected to the load circuit, the recognition circuit identifying the lamp connected to the load circuit by the power rating of the lamp; wherein the recognition circuit determines the resistance of at least one filament of the lamp connected to the load circuit.

10. The circuit according to claim 9, wherein the recognition circuit determines the voltage across the terminals of the lamp.

11. The circuit according to claim 9, wherein the recognition circuit comprises a microprocessor.

12. The circuit according to claim 9, wherein the recognition circuit comprises a threshold circuit and a current source.

13. The circuit according to claim 9, wherein the recognition circuit comprises a sensor, the sensor determining whether the lamp has been replaced.

14. The circuit according to claim 13, wherein the recognition circuit operates after the lamp has been replaced.

15. The circuit according to claim 9 further comprising a switching control means connected to the inverter switches and controlling the opening and closing of the inverter switches to supply the load circuit with a high frequency alternating signal;

the switching control means responsive to the recognition circuit to vary the signal supplied to the load circuit according to the power rating of the lamp.

16. The circuit according to claim 15, wherein the switching control means comprises an integrated circuit.

17. The circuit according to claim 15, wherein the switching control means comprises:

a control transformer with a primary winding and at least one secondary winding, the primary winding connected with the load circuit and at least one secondary winding being connected to the inverter switches, the peak voltage of one of the secondary windings being adjusted by the recognition circuit.

18. The circuit according to claim 15, wherein the switching control means comprises:

a control transformer having an auxiliary winding;

wherein the recognition circuit modifies the conditions of current flow in the auxiliary winding according to the power rating of the lamp connected to the load circuit.

19. The circuit according to claim 18, further comprising a current source connected between the recognition circuit and the auxiliary winding, the current source providing current to the auxiliary winding as directed by the recognition circuit.

20. The circuit according to claim 15 further comprising an oscillator connected between the switching control means and the recognition circuit, the oscillator controlling the switching control means to modify the switching conditions of the inverter switches according to the type of lamp connected to the load circuit.

21. The circuit according to claim 20, wherein the oscillation frequency of the oscillator is modified by the recognition circuit.

22. The circuit according to claim 20, wherein the duty cycle of the output signal of the oscillator is modified by the recognition circuit.

23. The circuit according to claim 20, wherein the output of the oscillator is switched off for an off time interval whose duration is set by the recognition circuit.

24. A power supply circuit for discharge lamps having a filament, comprising:

an inverter including a pair of inverter switches;

a load circuit connected to the inverter and adapted to receive at least one discharge lamp having a power rating;

a recognition circuit connected to the load circuit, the recognition circuit identifying the lamp connected to the load circuit by the power rating of the lamp; and an ambient temperature sensor;

wherein the recognition circuit determines the voltage across the terminals of the lamp and the power rating of the lamp as a function of the ambient temperature and said voltage across the terminals of the lamp.

25. The circuit according to claim 24, wherein the recognition circuit comprises a microprocessor.

26. The circuit according to claim 24, wherein the recognition circuit comprises a threshold circuit and a current source.

27. The circuit according to claim 24, wherein the recognition circuit comprises a sensor, the sensor determining whether the lamp has been replaced.

28. The circuit according to claim 27, wherein the recognition circuit operates after the lamp has been replaced.

29. The circuit according to claim 24 further comprising an oscillator connected between the switching control means and the recognition circuit, the oscillator controlling the switching control means to modify the switching conditions of the inverter switches according to the type of lamp connected to the load circuit.

30. The circuit according to claim 29, wherein the oscillation frequency of the oscillator is modified by the recognition circuit.

31. The circuit according to claim 29, wherein the duty cycle of the output signal of the oscillator is modified by the recognition circuit.

32. The circuit according to claim 29, wherein the output of the oscillator is switched off for an off time interval whose duration is set by the recognition circuit.

33. The circuit according to claim 24 further comprising a switching control means connected to the inverter switches and controlling the opening and closing of the inverter switches to supply the load circuit with a high frequency alternating signal;

the switching control means responsive to the recognition circuit to vary the signal supplied to the load circuit according to the power rating of the lamp.

34. The circuit according to claim 33, wherein the switching control means comprises an integrated circuit.

35. The circuit according to claim 33, wherein the switching control means comprises:

a control transformer with a primary winding and at least one secondary winding, the primary winding connected with the load circuit and at least one secondary winding being connected to the inverter switches, the peak voltage of one of the secondary windings being adjusted by the recognition circuit.

36. The circuit according to claim 33, wherein the switching control means comprises:

a control transformer having an auxiliary winding;

wherein the recognition circuit modifies the conditions of current flow in the auxiliary winding according to the power rating of the lamp connected to the load circuit.

37. The circuit according to claim 36, further comprising a current source connected between the recognition circuit and the auxiliary winding, the current source providing current to the auxiliary winding as directed by the recognition circuit.

* * * * *

UNITED STATES PATENT AND TRADEMARK OFFICE

CERTIFICATE OF CORRECTION

PATENT NO. : 6,081,077
DATED : June 27, 2000
INVENTOR(S) : Antonio Canova and David Martini It is certified that error appears in the above-identified patent and that said Letters Patent is hereby corrected as shown below:

On the Title Page:

Item [75], Inventors should read:
Antonio Canova, Montevarchi, Arezzo, Italy
David Martini, San Giovanni Valdarno, Arezzo, Italy Item [73], Assignee should read:
MagneTek S.P.A. Terranuova Bracciolini, (Arezzo), Italy Signed and Sealed this Thirty-first Day of July, 2001

*Attest:*

Nicholas P. Godici

*Attesting Officer*

NICHOLAS P. GODICI
*Acting Director of the United States Patent and Trademark Office*